US005947587A

United States Patent [19]

Keuper et al.

[11] Patent Number: 5,947,587

[45] Date of Patent: Sep. 7, 1999

[54] SIGNAL LAMP WITH LEDS

[75] Inventors: Matthijs H. Keuper; Antonius J. M. Van Hees, both of Eindhoven, Netherlands

[73] Assignee: U.S. Philips Corporation, New York, N.Y.

[21] Appl. No.: 08/943,310

[22] Filed: Oct. 14, 1997

[30] Foreign Application Priority Data

Oct. 16, 1996 [EP] European Pat. Off. ..... 96202883

[51] Int. Cl.[6] ..... F21V 5/00

[52] U.S. Cl. ..... 362/235; 362/268; 362/331; 362/800

[58] Field of Search ..... 362/227, 235, 362/236, 240, 242, 243, 244, 252, 800, 268, 331

[56] References Cited

U.S. PATENT DOCUMENTS

| | | | |
|---|---|---|---|
| 4,684,919 | 8/1987 | Hihi | 362/244 |
| 4,965,876 | 10/1990 | Foldi et al. | 362/247 |
| 5,006,971 | 4/1991 | Jenkins | 362/252 |
| 5,388,035 | 2/1995 | Bodem, Jr. | 362/244 |
| 5,567,036 | 10/1996 | Theobald et al. | 362/236 |
| 5,580,156 | 12/1996 | Suzuki et al. | 362/240 |

FOREIGN PATENT DOCUMENTS

| | | |
|---|---|---|
| 1227404 | 10/1966 | Germany . |
| 458240 | 3/1989 | Sweden . |
| WO9118242 | 11/1991 | WIPO . |

*Primary Examiner*—Alan Cariaso
*Attorney, Agent, or Firm*—F. Brice Faller

[57] ABSTRACT

The invention relates to a signal lamp comprising a box-shaped housing having an open end, a number of LEDs being provided in the housing and the open end of the housing being closed by means of a spreading window. The invention is characterized in that the LEDs are clustered around the central axis of the housing and in that the lamp comprises a positive lens (preferably a fresnel lens). The signal lamp in accordance with the invention provides an optimum, homogeneous brightness distribution on the surface of the spreading window. Preferably, the lens has a focal distance f, the LEDs are arranged at a distance v from the lens, and $0.55<v/f<0.975$. This measure contributes to the intended optimum homogeneous brightness distribution.

8 Claims, 3 Drawing Sheets

SIGNAL LAMP WITH LEDS

BACKGROUND OF THE INVENTION

The invention relates to a signal lamp comprising a box-shaped housing having an open end, a number of LEDs being accommodated in the housing and the open end of the housing being closed by a spreading window.

Such signal lamps are known per se. They are used, inter alia, in signal lighting for controlling different types of traffic, such as in traffic lights. Lamps of this type comprise a large number of light-emitting diodes (LEDs), which are regularly distributed on the entire inner surface of the housing. The spreading window of such a signal lamp ensures a proper distribution of the light intensity and, if necessary, a homogeneous brightness distribution. It is noted that "distribution of the light intensity" is to be understood to mean in this context, the angle-dependent distribution of the light intensity. "Brightness distribution" is to be understood to mean in this context, the angle-independent light distribution on the surface of the spreading window of the signal lamp.

It is also known to structure the spreading window of a signal lamp with LEDs in such a manner that each of the LEDs is provided with an optical system of its own which is integrated in the spreading window. By virtue of the presence of such an optical system, the brightness distribution of the window is optimal during operation of the lamp. The currently used signal lamps comprise more than 400 LEDs. However, there is a tendency to reduce this number. This tendency is also caused by the fact that LEDs having a higher light output are becoming available. For example, the latest signal lamps only comprise 150–200 LEDs.

Signal lamps of the above-mentioned type have an important drawback. It has been found that failure of one or more of the LEDs of such a lamp gives rise to an inhomogeneous brightness distribution on the surface of the spreading window. This disadvantage manifests itself in the form of dark spots on the window of the lamp. As a result, after failure of one or more LEDs, the known signal lamps no longer meet the requirements as regards the homogeneity of the brightness distribution. This problem increases as the number of LEDs per lamp decreases.

SUMMARY OF THE INVENTION

It is an object of the invention to provide a signal lamp of the above-mentioned type, in which failure of one or more LEDs causes no, or less, inhomogeneity in the brightness distribution on the surface of the spreading window of the lamp.

The invention is based on the insight that clustering the LEDs around the axis of the lamp envelope in combination with the use of a positive lens leads to a homogeneous brightness distribution of the signal lamp, which is hardly, or perhaps not at all, influenced by failure of one or more LEDs. Unlike the known signal lamps, the LEDs of the signal lamp in accordance with the invention are not distributed on the entire surface of the housing, but clustered around the central axis of the lamp envelope. In the lamp in accordance with the invention, the illuminated areas on the lens formed by the LEDs largely overlap. As a result, in the case of failure of one or more LEDs, the homogeneity of the brightness distribution on the surface of the spreading window decreases hardly.

In general, the housing of the lamp in accordance with the invention is bowl-shaped. Such a housing has an (imaginary) central axis around which the housing is formed in a substantially rotationally-symmetrical manner. The measure in accordance with the invention can also be used, however, in other types of housings, such as housings whose open end is oval or more or less rectangular. In that case, the housing has a central axis around which the housing is arranged substantially mirror-symmetrically. In both cases, the central axis extends substantially at right angles to the positive lens. It is noted that the lens can additionally be used as a spreading window. Preferably, the spreading window is accommodated in the inventive lamp as a separate optical component.

A preferred embodiment of the signal lamp in accordance with the invention is characterized in that the lens is a fresnel lens. This measure enables compact and cheap signal lamps to be manufactured. The use of a fresnel lens has the additional advantage of smaller light losses at the edge of the lens as compared to a spherical positive lens.

The LEDs are provided on a relatively small part of the inner surface of the housing. In accordance with a preferred embodiment of the invention, the inner surface of the housing on which the LEDs are clustered is maximally 25% of the surface of the lens. If a larger portion of the inner surface is provided with LEDs, then the outermost LEDs contribute insufficiently to the light-intensity distribution of the lamp. Optimum results are achieved when the inner surface of the housing on which the LEDs are clustered is 5–15%.

An interesting embodiment of the signal lamp is characterized in that the lens has a focal distance f, the LEDs are arranged at a distance v from the lens, and $0.55<v/f<0.975$.

It has been found that the arrangement of the LEDs at the focal distance from the lens has a substantial adverse effect on the intended homogeneous distribution of the intensity of the light presented to the spreading window of the lamp. In this case, the spreading window must perform two functions, i.e. the homogenization of the distribution of the light intensity and the homogenization of the brightness distribution. This causes the construction of the window to be more complicated and hence more expensive. If, however, the LEDs are arranged out of focus such that $0.55<v/f<0.975$, then a relatively homogeneous distribution of the intensity of the light presented to the spreading window is achieved. The homogeneity of this light-intensity distribution is optimal if, for both the focal distance and the distance between the LEDs and the lens, it applies that the ratio v/f is approximately 0.90. In this case, the spreading window only has to fulfill one function, i.e. the homogenization of the brightness distribution.

The aperture angle of the LEDs and the position of the LEDs in the housing are preferably adapted to each other in such a manner that, during operation of the lamp, the light generated by the LEDs is substantially (i.e. more than 90%) incident on the lens. The use of this constructional measure enables the light efficiency of the signal lamp to be used maximally. If the LEDs are positioned incorrectly, a part of the light generated by the LEDs may also be incident on the inner surface of the housing. As (the inner surface of) the housing customarily consists of a black, light-absorbing material, the part of the light which is not incident on the lens is lost. Consequently, such a situation adversely affects the efficiency of the signal lamp.

In another interesting embodiment of the signal lamp LEDs are asymmetrically arranged in the housing relative to a flat plane in which the central axis of the lamp is situated. By asymmetrically positioning the LEDs clustered around the central axis of the housing, an important advantage is achieved. This measure has a substantial effect on the light-intensity distribution of the issuing light beam. In a signal lighting, for example a traffic light, the signal lamp in accordance with the invention must be secured so that the (imaginary) flat plane extends in the horizontal direction. By virtue of this position, it is achieved that the portion of the light which is given off underneath the flat plane is greater than the portion which is given off above said plane. For signal lamps, this is a desirable property.

It is noted that, for clarity, the Figures are not drawn to scale.

DETAILED DESCRIPTION OF THE PREFERRED EMBODIMENTS

Figure 1:
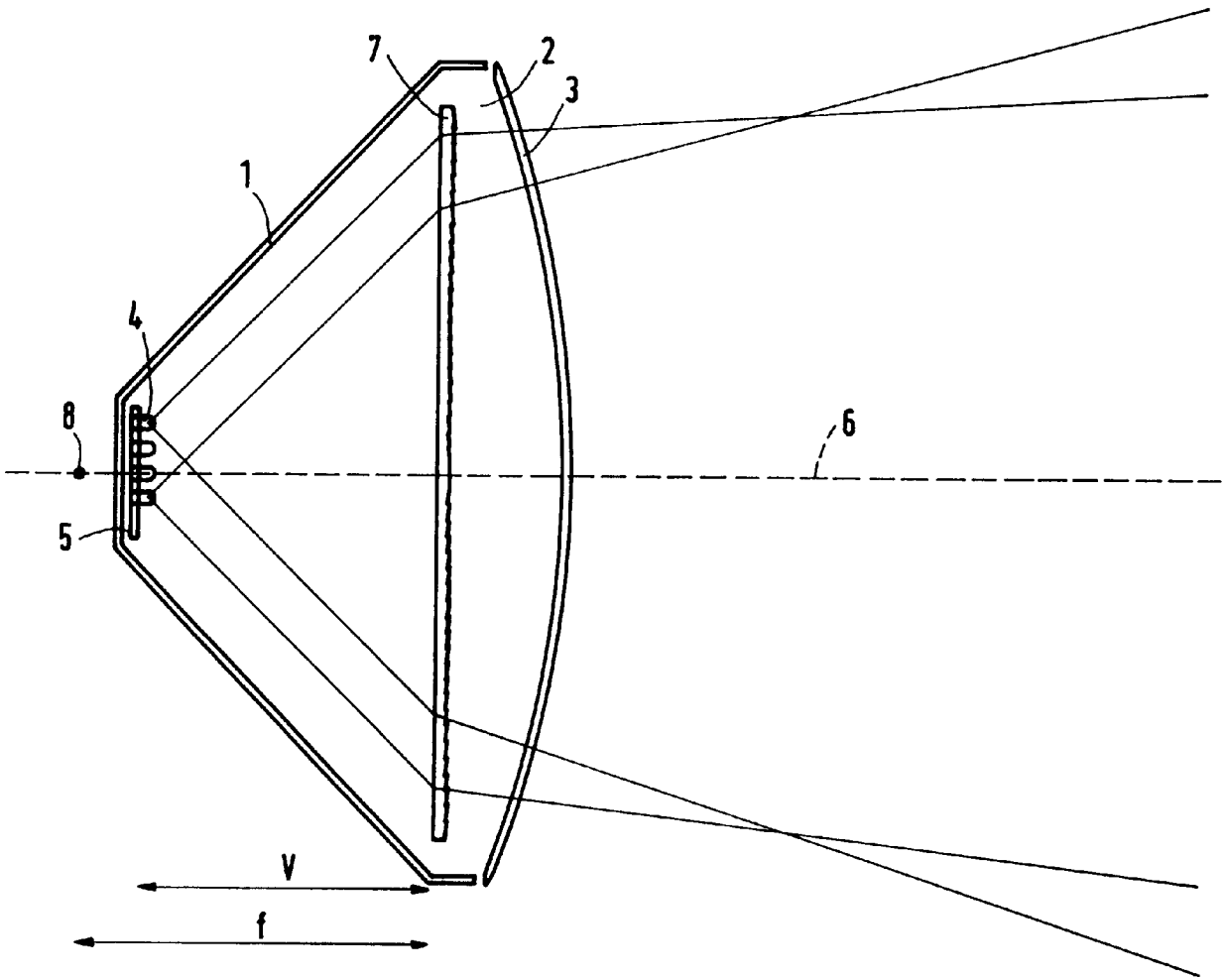
FIG. 1 is a schematic, sectional view of a signal lamp in accordance with the invention.
Figure 2A:
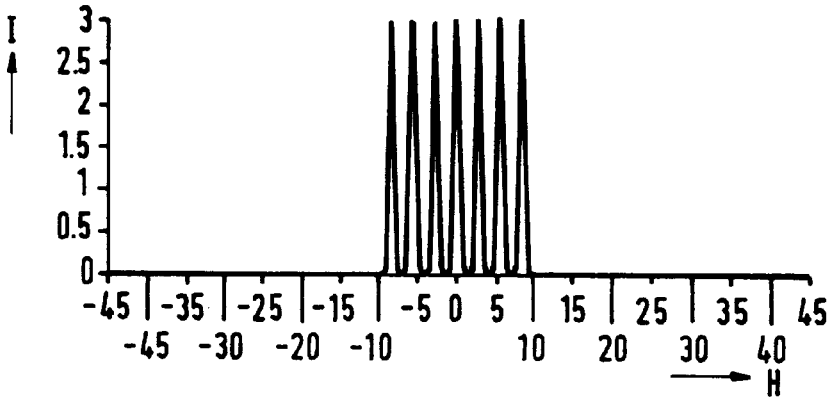
FIGS. 2A–2D show of beam distributions of a signal lamp with decreasing V/A ratios.
Figure 2B:
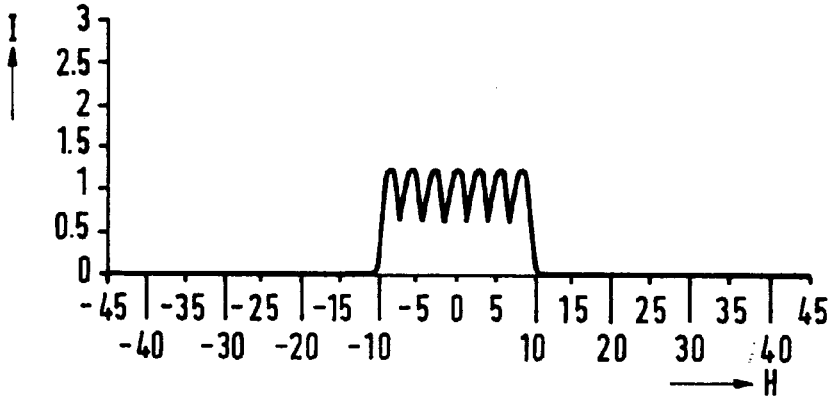
Figure 2C:
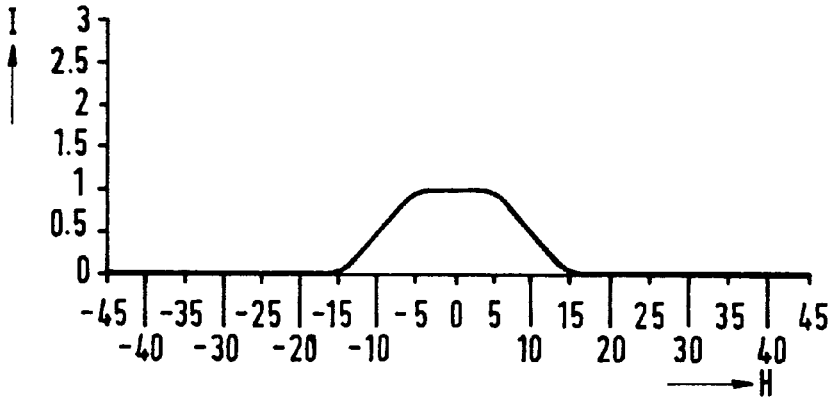
Figure 2D:
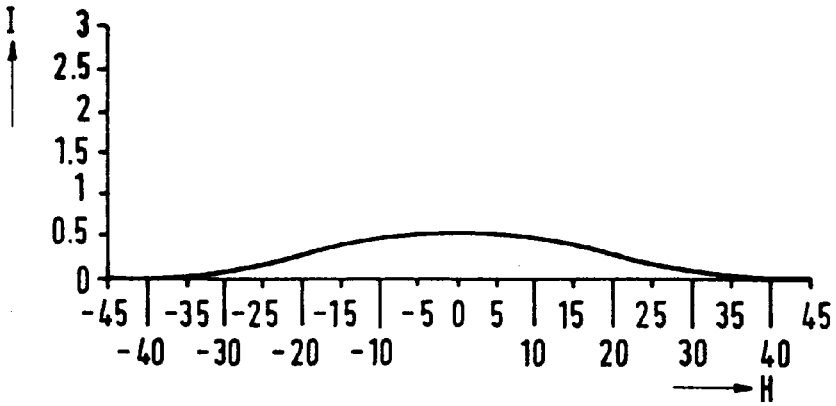

FIG. 1 is a schematic, sectional view of a signal lamp in accordance with the invention. This signal lamp comprises a box-shaped housing (1) of a light-absorbing, black synthetic-resin material (for example polycarbonate). The housing has an open end (2), which is closed by means of a spreading window (3). In this example, the spreading window is formed from a plastic material and its inner surface is structured in accordance with a desired pattern. The spreading window ensures a correct spread of the radiated light in the horizontal plane of the signal lamp.

The housing accommodates a relatively small number (fewer than 25) high-power LEDs (4) on a substrate (5), which is secured to the housing and forms part thereof. For clarity, the fastening means and the electric contacts of the LEDs are not shown. In the embodiment shown, 18 high-power LEDs are present. It is noted that high-power LEDs have a light flux of at least 3 lumen (lm). Depending on the type of LED, the signal lamp can give off light with a red, green or yellow color.

The signal lamp shown has an (imaginary) central axis (6) around which the housing is arranged in a substantially rotationally-symmetrical manner. The axis (6) extends at right angles to substrate (5) and lens (7), which, in this example, is a fresnel lens. The LEDs (4) are clustered around this axis. In the embodiment shown, the LEDs are lustered so that the inner surface of the housing on which the LEDs (4) are secured is smaller than 25% of the surface of the fresnel lens (7). In this case, the surface is approximately 10%. It has been found that, in the case of the signal lamp in accordance with the invention, failure of one or more LEDs (4) leads to a much smaller reduction of the homogeneity in the brightness distribution on the surface of the spreading window (3) than in signal lamps which are not provided with a fresnel lens and in which the LEDs are distributed on the entire inner surface of the housing.

The aperture angle of the LEDs (4) which are situated at the edge of the cluster is selected to be such that all the light generated by the LEDs (4) is directly incident on the fresnel lens (7). To explain this effect, the trajectory of the outermost beams of two LEDs of FIG. 1, which are situated at the edge of the cluster, is indicated. If a part of the light generated by the LEDs (4) is incident on the inner surface of the light-absorbing housing (1), then this light is lost. The light-absorbing effect of the housing reduces the so-called "phantom effect".

The focal point (8) of the fresnel lens (7) is situated on the central axis (6) at a distance f. The LEDs (4) are clustered at a distance v from the fresnel lens. As will be explained hereinbelow, the ratio v/f determines to a substantial degree the homogeneity in the light-intensity distribution of the signal lamp. In the example shown, this ratio is 0.90. An acceptable light-intensity distribution is achieved if this ratio ranges between 0.975 and 0.55.

FIG. 2 shows the graph of a number of (relative) light-intensity distributions of different embodiments of the signal lamp in accordance with the invention, in which the v/f ratio is chosen to be different. In the graph, the relative light intensity I is indicated as a function of the viewing angle H (degrees). In these embodiments of the signal lamp, a total of 7 high-power LEDs were used. The average distance from each LED to the nearest LED was approximately 5 mm. The focal distance f of the lens was 10 cm. The distance of the object v was varied in order to realize the v/f ratios given hereinbelow.

FIGS. 2-A to 2-D show the relative intensity distribution of the signal lamps in accordance with the invention, at a ratio of 0.99, 0.975, 0.90 and 0.55, respectively. From these Figures it can be derived that at a v/f ratio of 0.99 a very nonuniform light-intensity distribution of the beam is obtained. The beam distributions resulting from a ratio of 0.975 and 0.55 are only just acceptable. An optimum beam distribution is achieved if the v/f ratio is approximately 0.90.

Figure 3B:
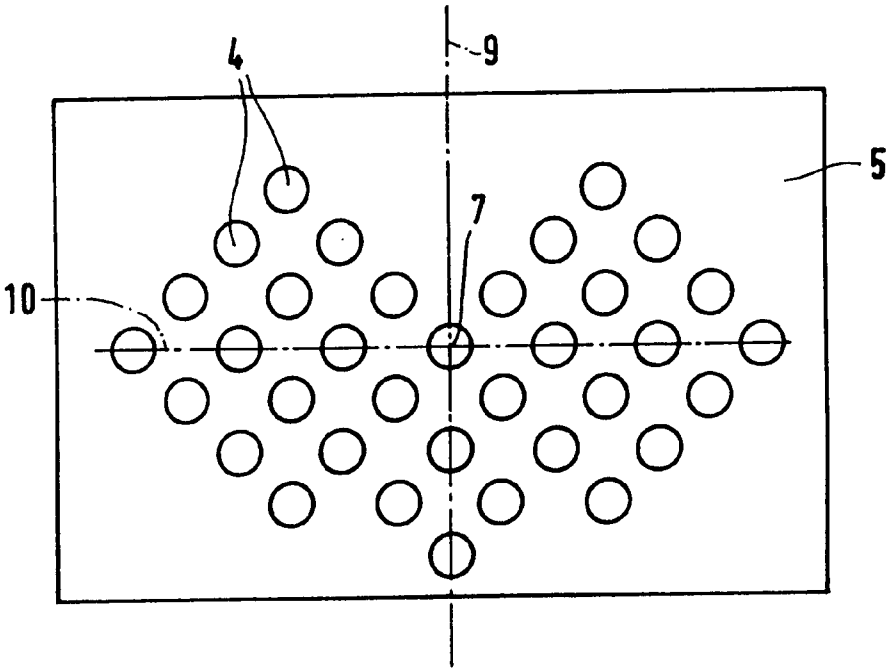
FIGS. 3A and 3B show of configurations in which the LEDs are positioned asymmetrically in the housing of a signal lamp in accordance with the invention.
Figure 3A:
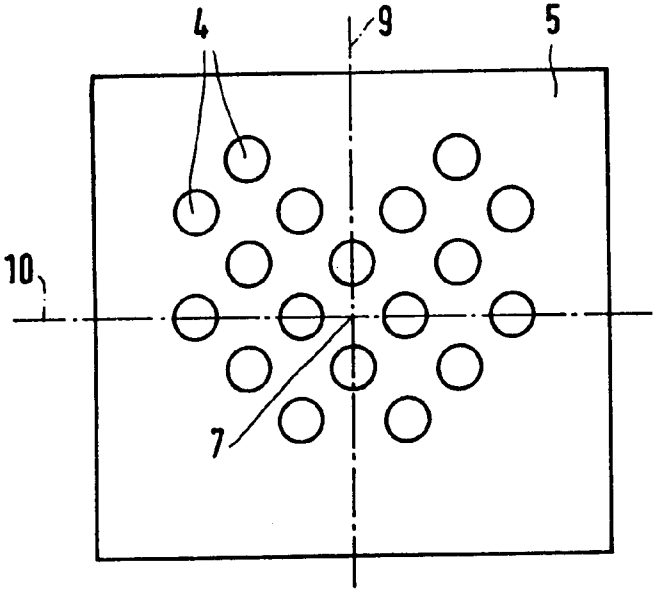

FIGS. 3A and 3B show asymmetric configurations of the 18 (FIG. 3-A) and 35 (FIG. 3-B) high-power LEDs (4) on a rectangular substrate (5), which can very advantageously be used in the signal lamp in accordance with the invention. The central axis extends at right angles to the plane of the drawing and is indicated by point (7).

Line (10) indicates a direction of the flat (first) plane relative to which the LEDs are arranged asymmetrically. If the signal lamp is positioned in a traffic device, this line (10) must extend substantially in the horizontal direction. The LEDs (4) are symmetrically arranged around line (9). Line (10) extends at right angles to line (9)which indicates a second plane. The asymmetry around line (10) ensures that the signal lamp generates an asymmetric light-intensity distribution in the vertical plane of the traffic device. If the signal lamp is secured in a traffic device, substrate (5) must also be positioned such that line (9) extends substantially in the vertical direction. This symmetry around line (9) ensures that the signal lamp generates a symmetric light-intensity distribution in the horizontal plane of the traffic device.

The signal lamp in accordance with the invention provides an optimum brightness distribution on the surface of the spreading window.

We claim:

1. A signal lamp comprising a housing arranged about a central axis, said housing having an open end on said axis, and an inner surface on said axis opposite from said open end, a spreading window closing said open end of said housing, a positive lens arranged between the inner surface and the spreading window, said lens having an area, and a plurality of light emitting diodes arranged on the inner surface for directing light toward said positive lens, said light emitting diodes being clustered about the central axis over an area which is less than 25% of the area of the lens.

2. A signal lamp as in claim 1, wherein said lens is a fresnel lens.

3. A signal lamp as in claim 1 wherein said lens has a focal point behind said inner surface, a focal distance f from said lens to said focal point, and a distance v from the lens to the light-emitting diodes, and $0.55<v/f<0.975$.

4. A signal lamp as in claim 1 wherein the light-emitting diodes are arranged so that substantially all light emitted by said light-emitting diodes is incident on the lens.

5. A signal lamp as in claim 1 wherein the light-emitting diodes are asymmetrically arranged with respect to a first plane in which the central axis is located.

6. A signal lamp as in claim 5 wherein the light emitting diodes are symmetrically arranged with respect to a second plane in which the central axis is located, said second plane being perpendicular to said first plane.

7. A signal lamp as in claim 1 wherein said housing is rotationally symmetric with respect to said central axis.

8. A signal lamp as in claim 1 wherein the central axis extends substantially perpendicularly to the positive lens.

* * * * *